US005845477A

United States Patent [19]

Stahlecker

[11] Patent Number: 5,845,477

[45] Date of Patent: Dec. 8, 1998

[54] DEVICE AND METHOD FOR FEEDING FIBER MATERIAL IN SLIVER FORM AND OPENING IT INTO SINGLE FIBERS

[75] Inventor: Fritz Stahlecker, Bad Überkingen, Germany

[73] Assignees: Fritz Stahlecker, Bad Überkingen; Hans Stahlecker, Süssen, both of Germany

[21] Appl. No.: 804,381

[22] Filed: Feb. 21, 1997

[30] Foreign Application Priority Data

Mar. 7, 1996 [DE] Germany ..... 196 08 830.5

[51] Int. Cl.[6] ..... D01H 4/32

[52] U.S. Cl. ..... 57/411; 57/408; 57/412

[58] Field of Search ..... 57/408, 409, 410, 57/411, 412, 413; 19/97.5, 105, 112

[56] References Cited

U.S. PATENT DOCUMENTS

| | | | |
|---|---|---|---|
| 4,024,699 | 5/1977 | Goldammer et al. | 57/412 |
| 4,055,942 | 11/1977 | Stahlecker | 57/412 |
| 4,109,453 | 8/1978 | Kobayashi et al. | 57/412 |
| 4,459,801 | 7/1984 | Stahlecker et al. | 57/412 |
| 4,590,757 | 5/1986 | Stahlecker | 57/412 |
| 4,901,519 | 2/1990 | Wassenhoven et al. | 57/412 |
| 4,926,627 | 5/1990 | Braun et al. | 57/412 |
| 5,185,994 | 2/1993 | Stahlecker | 57/412 |

FOREIGN PATENT DOCUMENTS

| | | |
|---|---|---|
| 2449311B2 | 4/1975 | Germany . |
| 2810184A1 | 9/1979 | Germany . |
| 4425347A1 | 1/1996 | Germany . |

*Primary Examiner*—Michael A. Neas
*Assistant Examiner*—Larry D. Worrell, Jr.
*Attorney, Agent, or Firm*—Evenson McKeown Edwards & Lenahan, PLLC

[57] ABSTRACT

An open end spinning unit is disclosed which includes a feeding device forming a fiber beard nipping line for a fiber beard extending downstream thereof. An opening device acts on a downstream end area of the fiber beard to open the fiber beard into separate fibers. A movable fiber take-up surface is provided separate from and downstream of the opening device for transporting the fibers to a yarn formation line. A fiber beard support guide guides the downstream end area of the fiber beard and the separated fibers so that the fibers continuously extend in a substantially stable direction without deflection as they travel between the nipping line and the take-up surface.

31 Claims, 12 Drawing Sheets

DEVICE AND METHOD FOR FEEDING FIBER MATERIAL IN SLIVER FORM AND OPENING IT INTO SINGLE FIBERS

BACKGROUND AND SUMMARY OF THE INVENTION

The present invention relates to a device for feeding fiber material in sliver form and opening it after it has left a nipping point in the form of a fiber beard, which travels essentially without deflection, comprising a feed roller, a feed table, which forms the nipping point together with the feed roller and supports the first part of the fiber beard after it has left the nipping point, and also a fiber opening device which acts on the end area of the fiber beard.

This application claims the priority of German application 196 088 830.5 filed on Mar. 7, 1996.

In the case of open-end spinning aggregates, the feed device usually consists of a feed roller and a feed table which, together with the feed roller, forms the nipping point for the fiber material. The fiber beard, which is to be opened into single fibers, is usually deflected over a deflection edge of the feed table or over a stationary fiber beard support (German published patent application DE 44 25 347) arranged downstream of the feed table, so that the end area of the fiber beard springs back, due to its own tension, to the fiber opening device, usually to the fitting on an opening roller. This does result in a more intensive combing effect of the fiber beard, but has the disadvantage that the single fibers in the combing area do not remain in a linear state.

Because of this, it was attempted to omit deflection of the fiber beard almost completely (U.S. Pat. No. 3,950,929) and provide instead a feed table, downstream of the nipping point, with a guiding surface extending essentially tangentially to the opening roller, which guiding surface supported the fiber beard downstream of the nipping point. Thus the single fibers remain in their linear state in the area directly downstream of the nipping point, but the end area of the unopened fiber beard is left unguided, which means that it can spring backwards toward the combing structure of the opening roller. This results in inadequate combing.

It is prior art (German published patent application 28 10 184) to feed the fiber beard from the nipping point of the feed device in a channel practically without deflection tangentially to the combing structure of an opening roller. The end area of the fiber beard is left here also unguided, so that it can evade the opening roller. The opened single fibers fly subsequently, more or less uncontrolled, in an air stream to the twist-giving wedge-shaped gap of two friction rollers.

It is an object of the present invention to improve a device of the above mentioned type, which corresponds to the latter prior art mentioned above, wherein a good opening of the single fibers takes place despite a non-deflected fiber beard, and whereby the opened single fibers are not left unguided.

This object of the present invention has been achieved in that the fiber opening device comprises structure which holds the end area of the fiber beard directionally stable, and that directly downstream of the end area of the fiber beard, a take-up surface for transporting the single fibers to a yarn formation line is provided.

The structure holding the end area of the fiber beard directionally stable, described at first in very general terms, and described below in more detail with the aid of numerous embodiments, ensures that the fiber beard is definitely forced into the range of the fiber opening device. The individual composition of each fiber opening device, to be described below in more detail, is thereby accommodated by the various embodiments. Even after the single fibers have been released from the nipped fiber beard, they are not left unguided, but rather are fed at a controlled speed to the yarn formation line. This yarn formation line can be defined by the wedge-shaped gap of two friction rollers or also by an air nozzle located downstream.

The present invention can be particularly advantageously applied in a spinning process whereby the single fibers, up to the finished yarn, are continuously accelerated. This is then the case when the circulating take-up surface has a speed which is somewhat higher than the arrival speed of the single fibers at the take-up surface, and when the yarn withdrawal speed is somewhat higher than the circumferential speed of the take-up surface. This presumes that the veil of opened single fibers has a width which already contains the number of single fibers required in the cross section of the spun yarn. Thus, a sufficiently wide sliver or a plurality of adjacently arranged slivers must be fed to the spinning arrangement. When the yarn formation line extends transversely to the transport direction of the single fibers, any drafting errors which occurred during the opening into single fibers will be extensively compensated for, as the single fibers are somewhat staggered in relation to each other in their withdrawal direction. This will be gone into in more detail in the description of the drawings.

The take-up surface is advantageously the air-permeable peripheral surface of a driven roller, suctioned from the inside, whose circumferential speed is at least as high as the arrival speed of the single fibers. In the case of such an embodiment, the single fibers are taken up and transported further in a particularly simple and effective way.

In an embodiment of the present invention, the fiber opening device comprises an opening roller equipped with opening structure, at which opening roller a supporting surface for the end area of the fiber beard is arranged. This variation thus derives from a standard opening roller, at which a supporting surface is purposefully arranged in the critical end area of the fiber beard. It is thereby advantageous when the supporting surface is provided with at least one air-supply channel which faces the peripheral surface of the opening roller and is inclined in its rotational direction. The fiber beard is thus forced into the opening structure of the opening roller.

The effect of the above-mentioned supporting surface can be increased in that a nipping piece is arranged at the opening roller, which nipping piece is flexibly pressed to the periphery of the opening roller. In this case, however, the opening roller must be provided with a working surface which enables a nipping piece to be disposed thereon. For this purpose, instead of a saw-tooth or needle-like opening structure, a smoother profiling would be provided.

In the case of another embodiment, the fiber opening device comprises a driven opening roller which has an air permeable peripheral surface which is suctioned from inside. Here a predominantly pneumatic fiber opening device is involved, in which the circumferential speed of the opening roller participates to a certain extent mechanically in the opening process. An additional roller, running in the opposite direction and identically constructed, can hereby be arranged adjacent the opening roller, so that the fiber beard is acted on from many sides.

In a further embodiment, the fiber opening device can comprise a splicer-like channel with blast openings. In this case the opening of the fiber beard to single fibers is effected pneumatically.

In another variation, the fiber opening device can comprise a driven ventilation roller, at which a supporting surface is arranged. The ventilation roller replaces thereby to a certain extent the wall of the splicer-like channel. It is advantageous that the supporting surface is provided with air-supply channels facing the circumferential direction of the ventilation roller.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
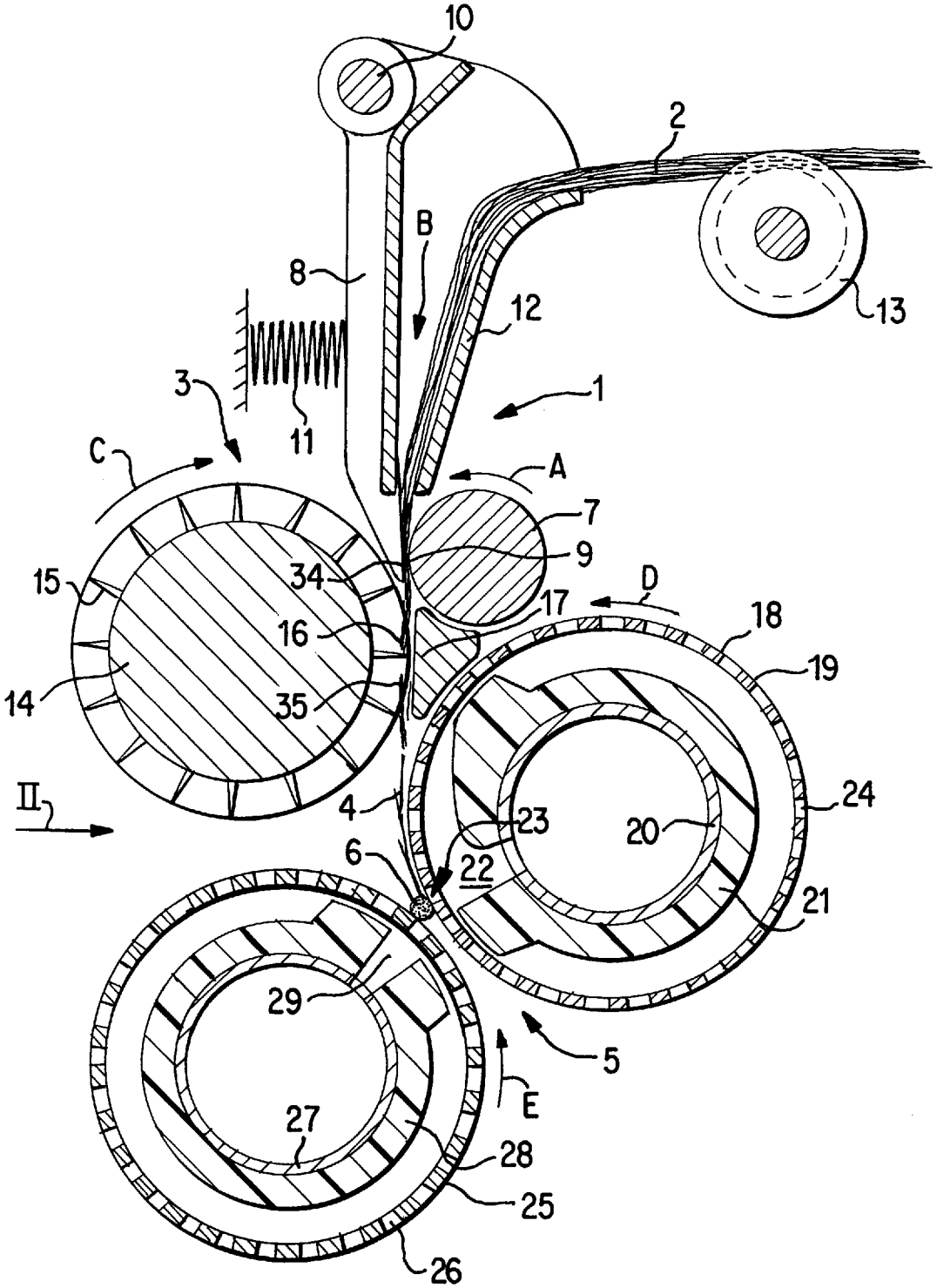
FIG. 1 is a sectional side schematic view of an open-end spinning aggregate, which comprises a feed device and an opening device according to a preferred embodiment of the present invention, including an opening roller and a supporting surface for the fiber beard.
Figure 2:
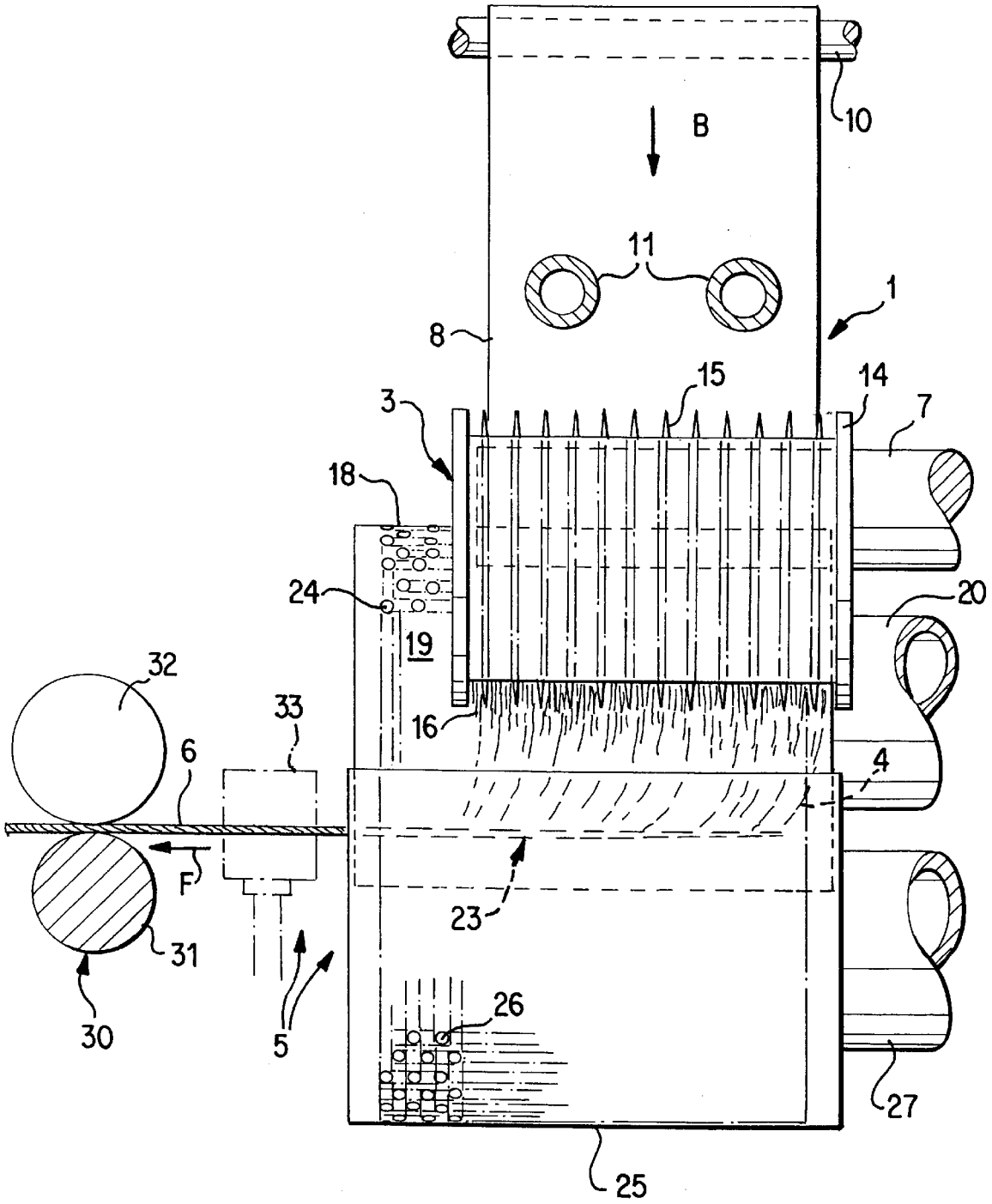
FIG. 2 is a view in the arrow direction II of FIG. 1, wherein some components have been omitted.

The device according to FIGS. 1 and 2 essentially comprises a feed device 1 for feeding fiber material 2 in the form of at least one sliver, a fiber opening device 3 for opening the fiber material 2 to single fibers 4 and a twist device 5 for spinning a yarn 6.

The feed device 1 comprises a feed roller 7 driven in rotational direction A, which forms a nipping point 9 together with a feed table 8 for the fiber material 2 fed in feed direction B. The feed table 8 can be swivelled around a swivel axle 10 and be pressed resiliently onto the feed roller 7 by one or more weighting springs 11. The fiber material 2, which can consist of one wide sliver or a plurality of adjacently arranged slivers, is guided to the nipping point 9 by a feed condenser 12, whereby a freely rotatable feeder roller 13 is arranged upstream thereof.

The fiber opening device 3 comprises an opening roller 14, which is equipped with a preferably needle-like opening structure 15. The opening roller 14 is driven in a circumferential direction C, which is in the opposite direction to the circumferential direction A of the feed roller 7. The opening roller 14 is located on the side of the end of the fiber material 2 facing away from the feed roller 7, which end, the so-called fiber beard 16, projects out over the nipping point 9.

A further part of the fiber opening device 3 is a supporting surface 17, which is arranged on the side of the fiber beard 16 facing away from the opening roller 14, and which ensures that the fiber beard 16 cannot evade the opening structure 15.

A roller 18 is arranged in the transport direction of the single fibers 4 which is driven in direction D, that is in the opposite direction to the opening roller 14. The roller 18 is provided with a peripheral surface which is air-permeable and suctioned from the inside and which serves as a take-up surface 19 for the single fibers 4 opened by the fiber opening device 3. The take-up surface 19 is arranged in direct proximity to the fiber beard 16.

The roller 18 is supported (not shown) on a vacuum tube 20, which also supports a sealing insert 21, which exposes a suction opening 22 facing the fiber beard 16. The suction opening 22 extends over a certain peripheral area of the roller 18 up to a yarn formation line 22, which extends in longitudinal direction of the surface line of the roller 18. The vacuum increases from the fiber beard 16 to the yarn formation line 23. The airpermeable peripheral surface is achieved by means of a perforation 24.

A friction roller 25, driven in the same direction E is arranged adjacent the roller 18, which friction roller 25 is closely adjacent to the roller 18 in the area of the yarn formation line 23, but without coming into contact therewith. The yarn formation line 23 lies in the wedge-shaped gap formed by the roller 18 and the friction roller 25. The peripheral surface of the friction roller 25 is provided with a perforation 26. The friction roller 25 is supported on a vacuum tube 27, which also supports a sealing insert 28, which exposes a suction opening 29 facing the yarn formation line 23.

In extension of the yarn formation line 23, a withdrawal device 30 for the spun yarn 6 is applied. The withdrawal device 30 transports the yarn 6 by means of a driven bottom roller 31 in yarn withdrawal direction F to a winder device (not shown). A pressure roller 32 is resiliently pressed onto the bottom roller 31.

The twist device 5 can be formed by the roller 18 and the friction roller 25, as is known in friction spinning. An air nozzle 33, denoted only by a dot-dash line, can, however, be arranged downstream of the yarn formation line 23, which air nozzle 33 either partakes in the twist formation, or generates the twist entirely itself.

The spinning process involving the device described above proceeds in such a way that the single fibers 4 created by the fiber opening device 3 are at no point slowed down, but rather ideally continuously accelerated. This begins with the circumferential speed there of the take-up surface 19 being somewhat higher than the arrival speed of the single fibers 4. Due to the take-up surface 19, the single fibers 4 are not fed to the yarn formation line 23 at an excessive speed, so that the yarn withdrawal speed, which is somewhat higher than the circumferential speed of the take-up surface 19, remains within a controllable limit. A prior condition for these speed ratios is that the single fibers 4 are disposed on the take-up surface 19 with a fiber veil, which already comprises at least the amount of single fibers 4 required for the size of the spun yarn 6. The single fibers 4 are disposed on the take-up surface 19 transversely to the transport direction in a wide fiber veil, so that they arrive at the yarn formation line 23 axially staggered with respect to one another. This can be seen in particular in FIG. 2. Any drafting errors which may have been caused by the fiber opening device 3 are compensated for by this axial staggering.

The device has firstly the advantage that the fiber beard 16 receives essentially no deflection from the nipping point 9 onwards, so that the single fibers 4 do not break off. The single fibers 4 have thus essentially the same direction as the fiber material 2 travelling in feed direction B towards the nipping point 9. The fiber beard 16 is fed approximately tangentially to the opening roller 14.

While the first area 34 of the fiber beard 16 is still supported by the feed table 8, support structure arranged at the end area 35 of the fiber beard 16 in the form of the supporting surface 17, which keeps the fiber beard 16 directionally stable and in particular prevents the end area 35 of the fiber beard 16 from evading the opening structure 15 by going backwards. The gap between the opening structure 15 and the supporting surface 17 should be accordingly narrow. After the single fibers 4 have been combed by the opening structure 15, they are taken up directly by the take-up surface 19, so that the single fibers 4 are not left unguided after opening. The suction opening 22 of the roller 18, as can be seen in FIG. 1, is very narrow at the start and widens towards the yarn formation line 23. As a result the suction is stronger going towards the yarn formation line 23.

In the embodiments to be described below, the same reference numbers will be used, insofar as components with identical functions are involved. A repeat description of these components can thus be omitted, and reference shall be made accordingly from here on to FIGS. 1 and 2. Only those components, which deviate from the embodiment in FIGS. 1 and 2 shall be described.

Figure 3:
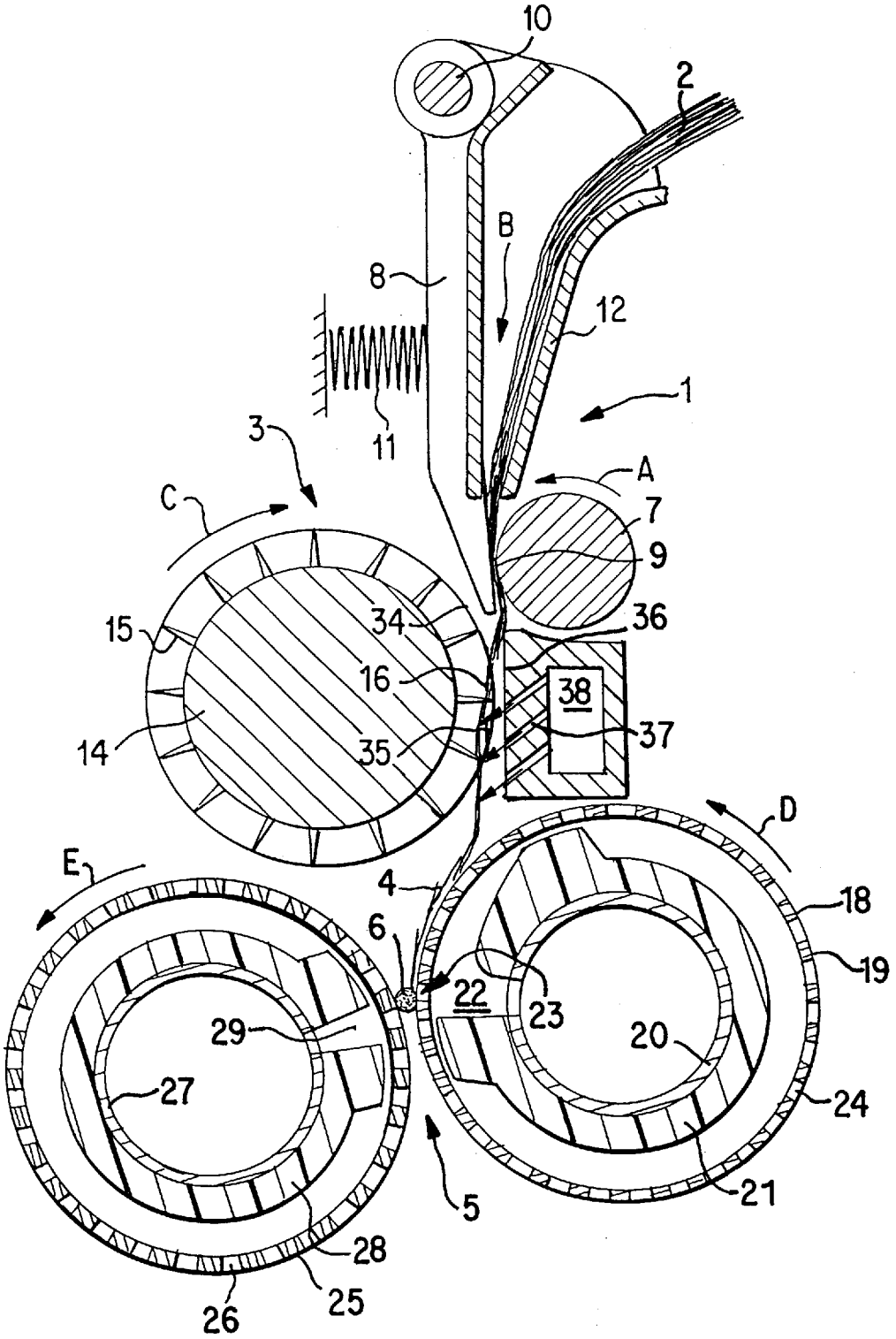
FIG. 3 is a view similar to FIG. 1, wherein the supporting surface is provided with ventilation channels, constructed according to another preferred embodiment of the invention.

The embodiment in FIG. 3 differs from the embodiment described above essentially in that the supporting surface 17 in FIG. 1 is replaced by a differently formed supporting surface 36, which comprises a plurality of air-supply channels 37. These air-supply channels 37 begin in a pressurized chamber 38, and face the peripheral surface of the opening roller 14 while being inclined in the circumferential direction C thereof. The end area 35 of the fiber beard 16 is thus forced into the opening structure 15 by means of. blast air, whereby evasion of the opening structure 15 by the fiber beard 16 is prevented.

The blast air contributes to the directional stability of the fiber beard 16.

Figure 4:
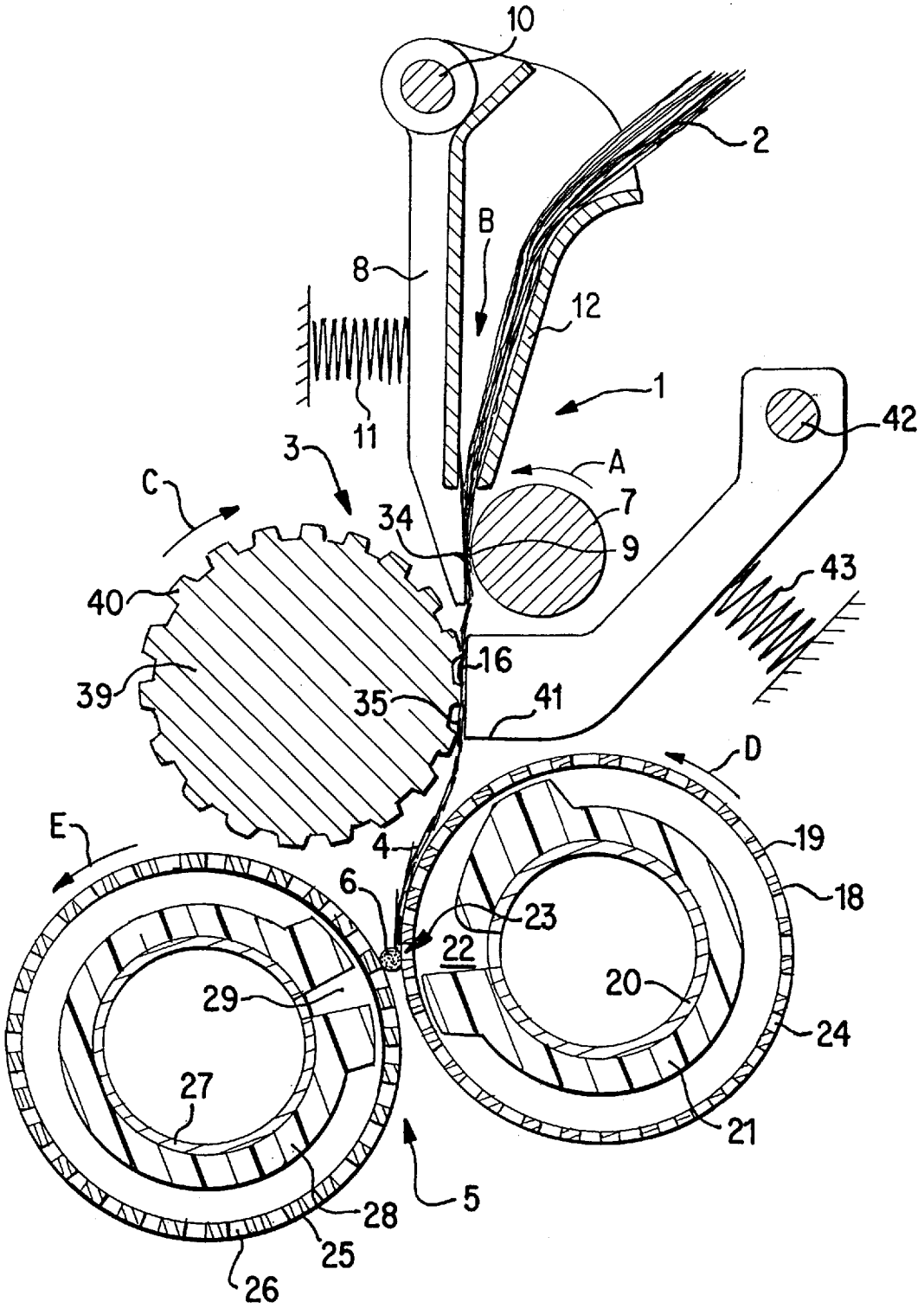
FIG. 4 is a view similar to FIG. 1, wherein a nipping piece is arranged at a differently constructed opening roller and flexibly pressed thereon, constructed according to another preferred embodiment of the invention.

In the embodiment in FIG. 4, an opening roller 39 driven in arrow direction C is shown, which differs from the opening roller 14 described above essentially in that instead of having opening structure 15 according to FIG. 1, openings structure 40 with a smoother profiling is provided. The opening structure 40 consists essentially of shallow grooves extending axially to the opening roller 39, the grooves forming pressure guides in the area of the opening roller 39 where the diameter is largest, against which pressure guides a nipping piece 41 is disposed. The fiber beard 16 and in particular its end area 35 are hereby flexibly pressed on the opening structure 40, without the single fibers 4 being damaged.

The nipping piece 41 has a lever-like construction and can be swivelled around a swivel axle 42 and is pressed lightly to the periphery of the opening roller 39 by means of a weighting spring 43

The opening roller 39, together with the nipping niece 41, form the support structure for the directional stability of the fiber beard 16.

Figure 5:
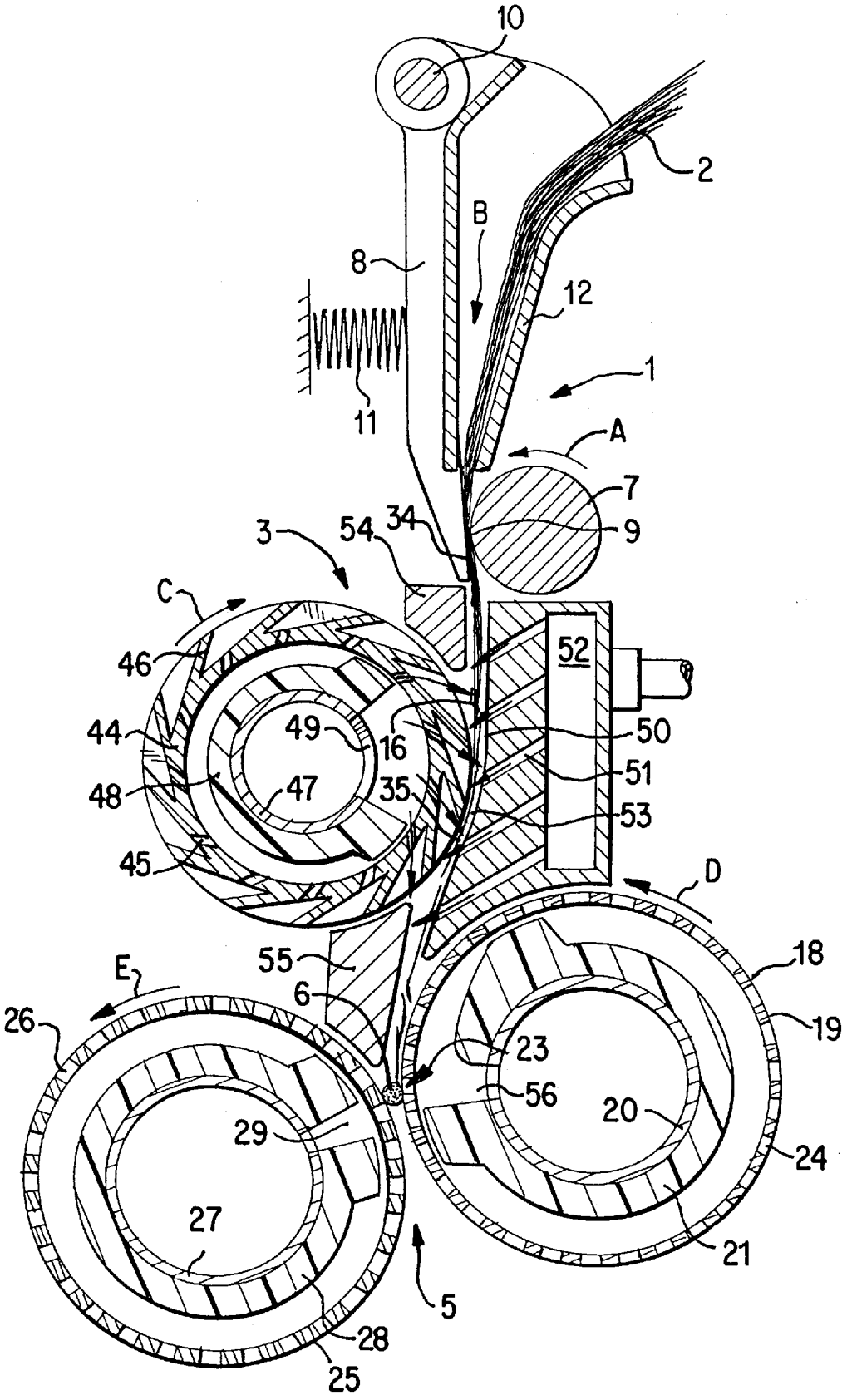
FIG. 5 is a view similar to FIG. 1, wherein the fiber opening device comprises a ventilation roller, constructed according to another preferred embodiment of the invention.

In the embodiment in FIG. 5, the opening rollers 14 and 39 described above are replaced by a ventilation roller 44, which is provided on its periphery with a perforation 45 and which is also driven in arrow direction C. Air guiding surfaces 46, inclined slightly in circumferential direction C, are arranged to the perforation 45. The ventilation roller 44 is supported on a pressurized tube 47, which also supports a sealing insert 48, which exposes a ventilation opening 49 facing the fiber beard 16.

A supporting surface 50 is arranged at the ventilation roller 44, which is similarly constructed to the one described already in FIG. 3. The supporting surface 50 has a plurality of air supply channels 51, which extend from a pressurized chamber 52.

Between the ventilation roller 44 and the supporting surface 50, an opening channel 53 is formed, in which the single fibers 4 are separated pneumatically from the fiber beard 16. The opening channel 53 is extended at its beginning and end by means of stationary filler pieces 54 and 55.

The roller 18 containing the take-up surface 19 has in this case a suction opening 56 which is smaller than the suction opening 22 described up to now. The suction opening 56 in FIG. 5 essentially faces only the area of the yarn formation line 23, so that the single fibers 4 only then reach the take-up surface 19 of the roller 18 after a very short distance.

Figure 6:
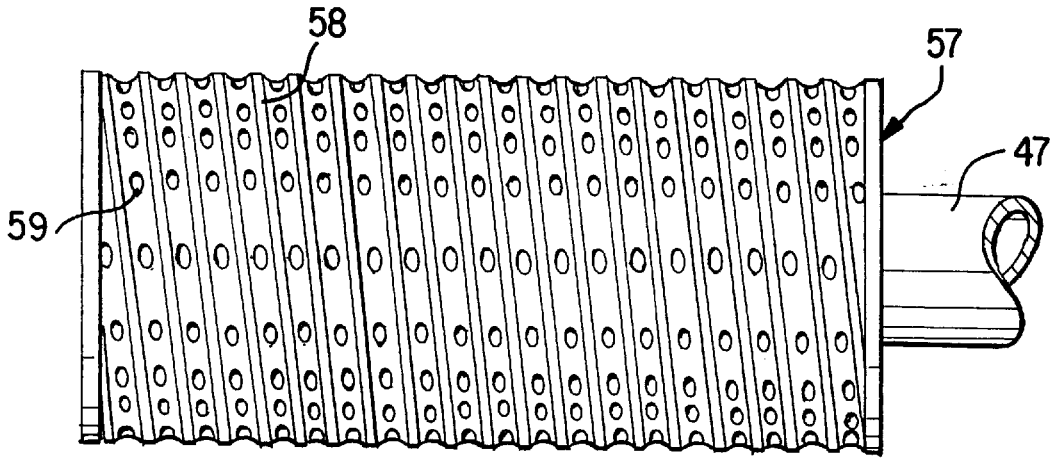
FIG. 6 is a side view of a ventilation roller for use with the spinning aggregate of FIG. 5.

A ventilation roller 57 is shown in FIG. 6, which for example could be applied in the embodiment in FIG. 5. In addition to the perforation 59, the periphery of the ventilation roller 57 is provided with a screw thread structure 58, which to a certain extent acts on the fiber beard 16 mechanically. The grooves formed by the screw thread structure 58 should measure 1.5 mm deep.

Figure 7:
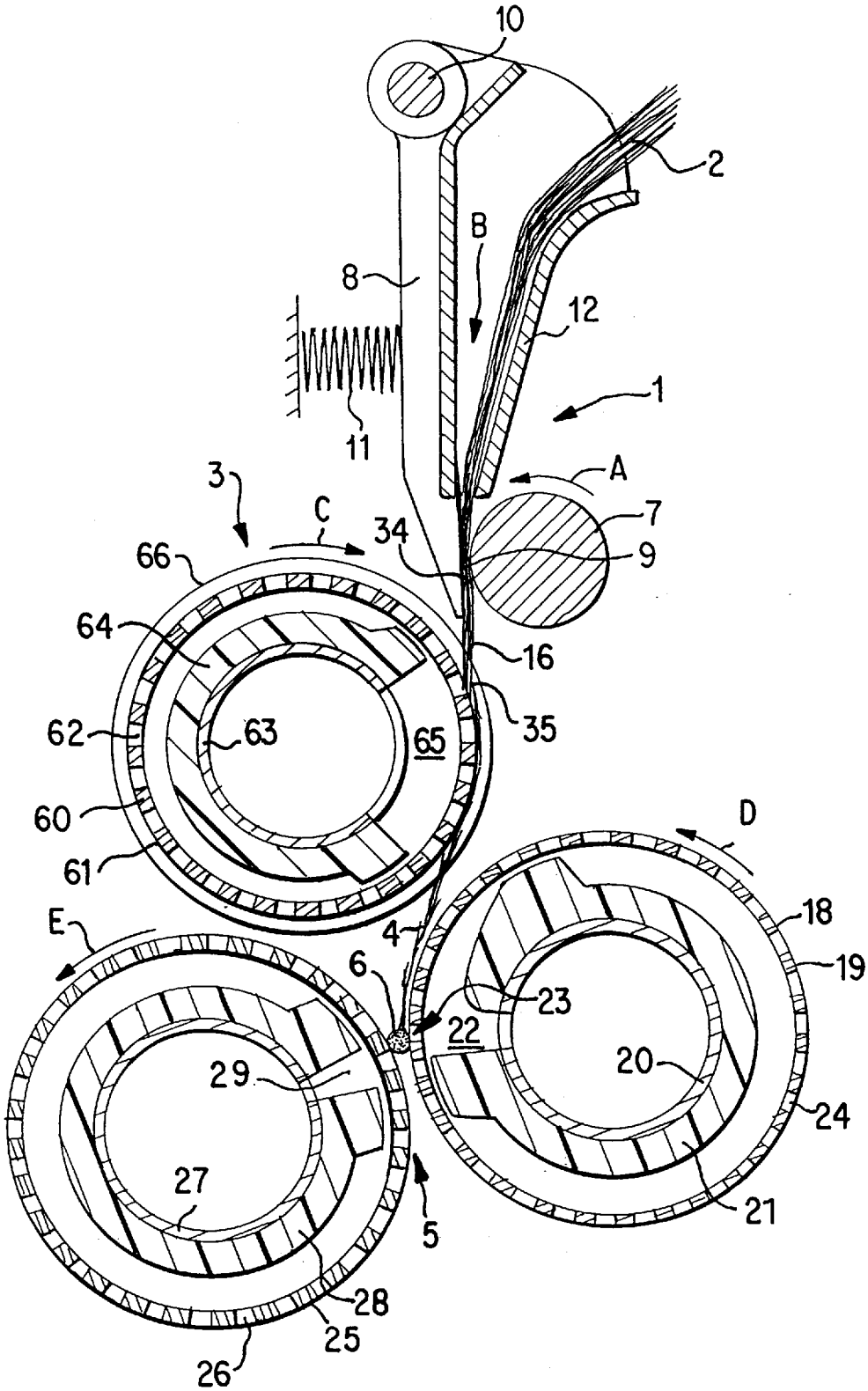
FIG. 7 is a view similar to FIG. 1, wherein an opening roller is provided with an air-permeable peripheral surface which is suctioned from the inside, constructed according to another preferred embodiment of the invention.

In the embodiment in FIG. 7 an opening roller 60 driven in arrow direction C is provided, which comprises an air-permeable peripheral surface 61 and is suctioned from the inside. The opening roller 60 thus opens the fiber beard 16 into single fibers 4 by predominantly pneumatic effect. The perforation 62 is similarly constructed to the one on the roller 18 containing the take-up surface 19. The opening roller 60 is supported on a vacuum tube 63, which also supports a sealing insert 64, which exposes a suction opening 65 facing the fiber beard 16. The opening roller 60 can have an additional profiling 66, which will be described below with the aid of FIG. 8.

In the embodiment in FIG. 7, the structure which keeps the end area 35 of the fiber beard 16 directionally stable are achieved by the suction of the fiber beard 16 to the periphery of the opening roller 60.

Figure 8:
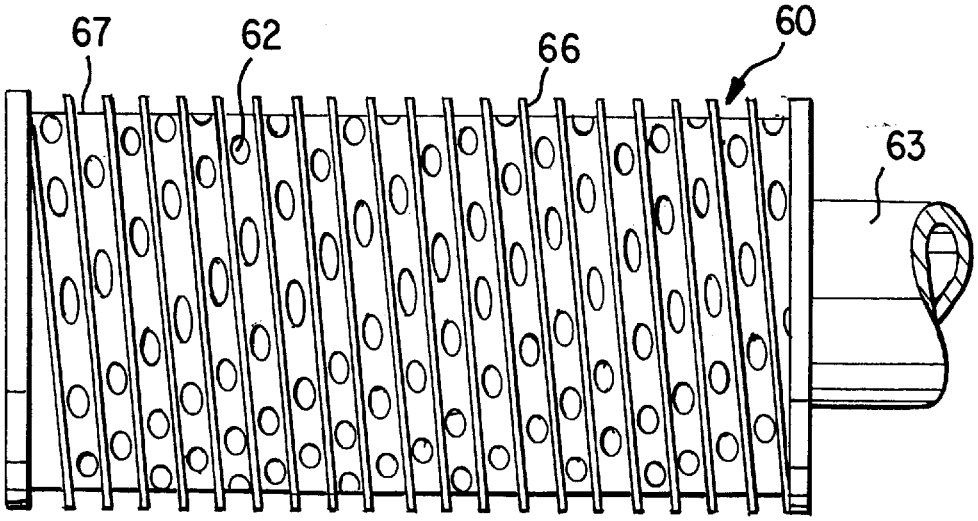
FIG. 8 is a side view of an opening roller applicable according to the FIG. 7 embodiment.

The opening roller 60 shown in FIG. 8 comprises in addition to the perforation 62 a helical-shaped arranged profiling 66, which forms so-called suction grooves 67. This results not only in an enlarged supporting surface in the area of the perforation 62 for the fiber beard 16, but also in a mechanical taking-along effect due to the lateral friction. The perforation 62 can be formed by a chain of elongated holes, which are arranged staggered with respect to one another in axial direction. This type of elongated hole is easily made today by means of laser technology.

Figure 9:
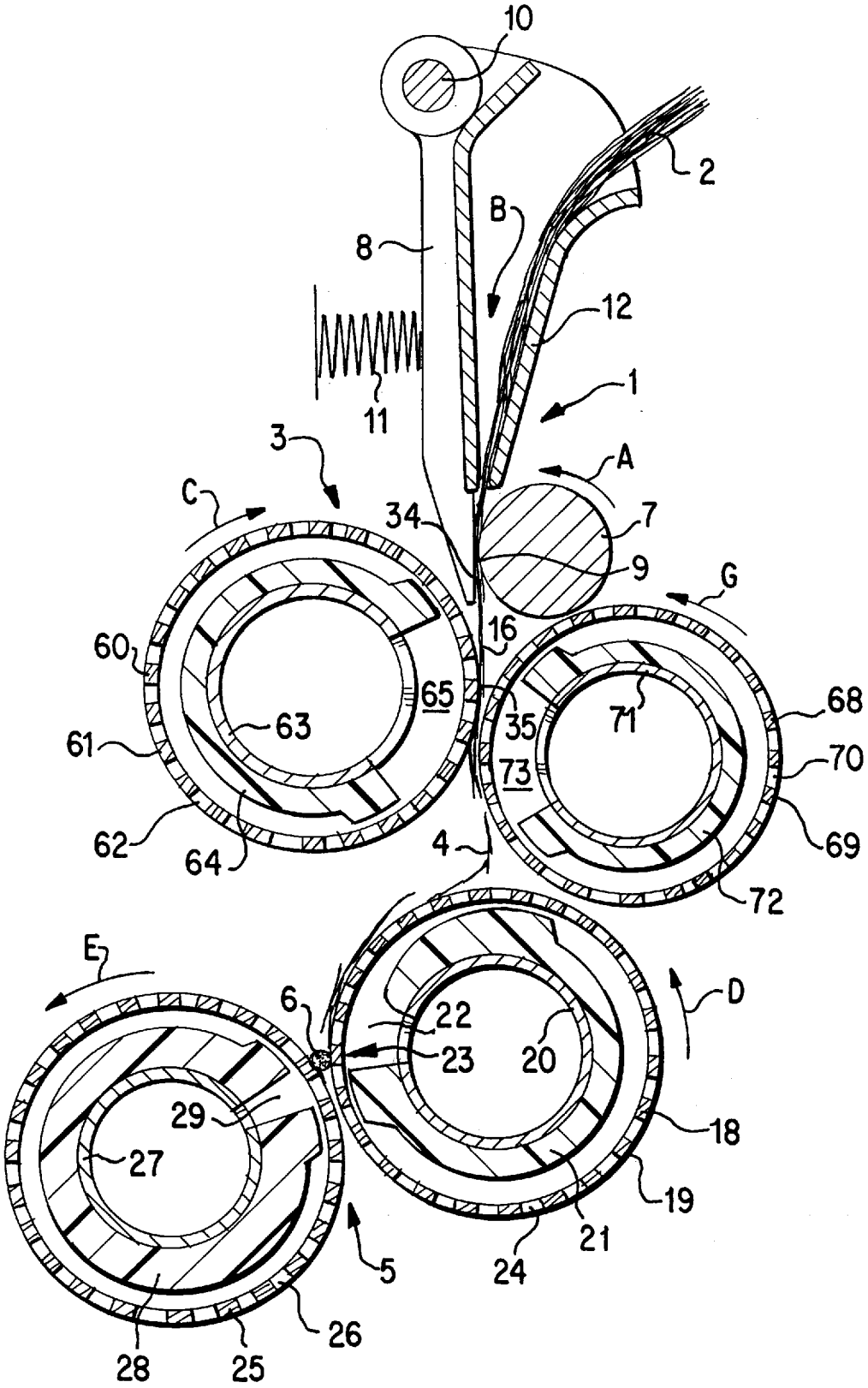
FIG. 9 is a view similar to FIG. 7, wherein an additional roller, identically constructed but running in the opposite direction to the opening roller, is arranged thereto, constructed according to another preferred embodiment of the invention.

The embodiment in FIG. 9 differs from the embodiment in FIG. 7 essentially in that an additional roller 68, identically constructed but rotating in the opposite direction in arrow direction G, is arranged adjacent the opening roller 60. The additional roller 68 comprises also an air-permeable peripheral surface 69 which is provided with a perforation 70 and is suctioned from within. The additional roller 68 is supported on a vacuum tube 71, which supports a sealing insert 72 with a suction opening 73 facing the end area 35 of the fiber beard 16.

Due to the opening roller 60 acting together with the additional roller 68, the fiber beard 16 is not only acted on pneumatically from both sides, but is also held directionally stable. The single fibers 4 are taken up directly downstream of the additional roller 68 by the take-up surface 19 of the roller 18 driven in arrow direction D and then fed to the yarn formation line 23 in a way described above.

The embodiments described below differ from the variations described above essentially in that the yarn opening device 3 is comprises no rotating rollers at all, but rather only stationary components.

Figure 10:
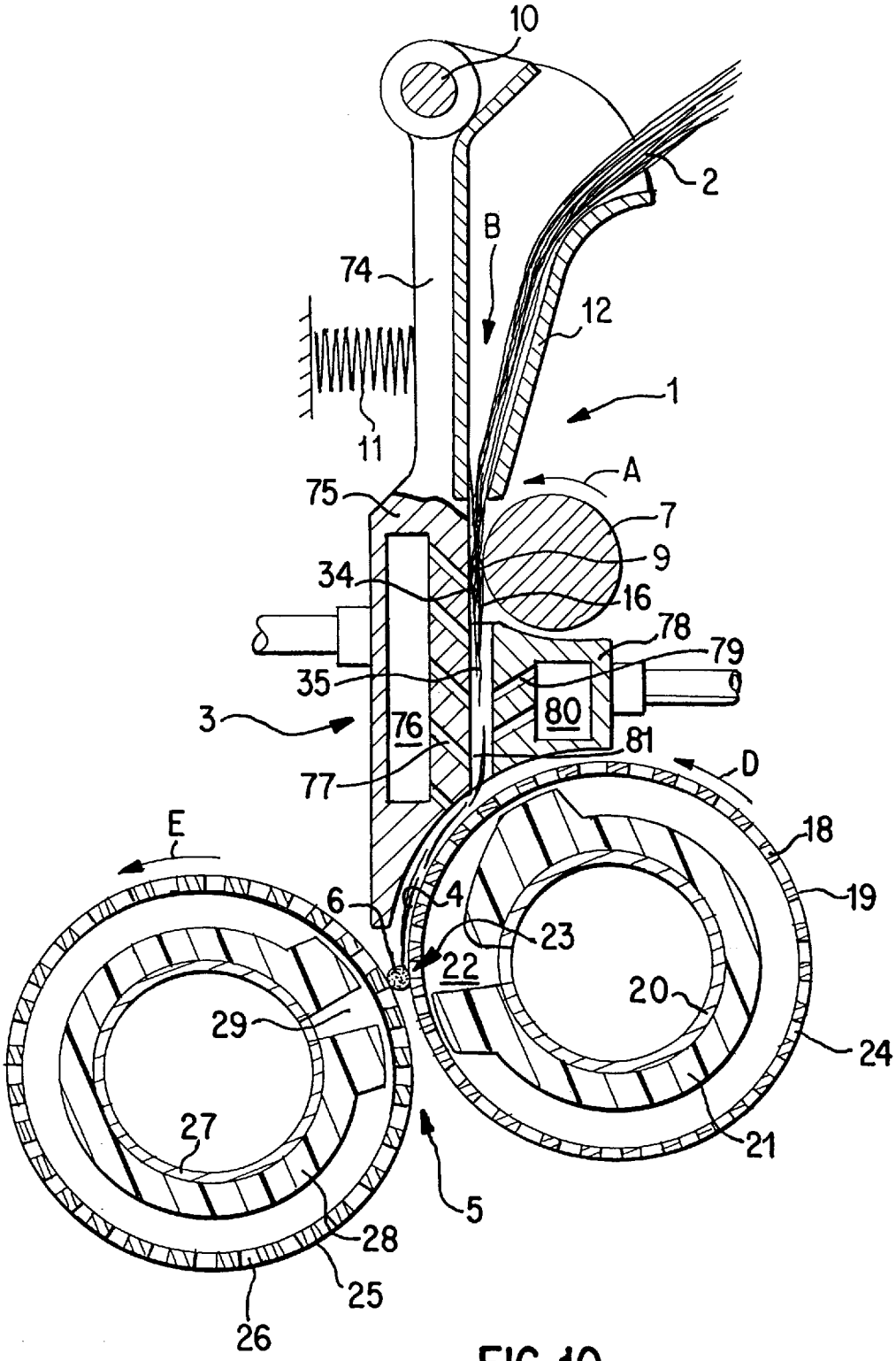
FIG. 10 is a view similar to FIG. 1, wherein the fiber opening device is formed by a splicer-like channel, constructed according to another preferred embodiment of the invention.

In the embodiment according to FIG. 10, a feed table 74 is provided, which differs insofar from the feed table 8 in that it is provided with an extension 75 in the area of the nipping point 9 Inside the extension 75 a pressurized chamber 76 is present, from which a plurality of blow openings 77 extend facing the fiber beard 16. An upper part 78 acts together with the extension 75, which upper part 78 can be either a separate component, or be connected to the extension 75 in a detachable way. The upper part 78 is also provided with blow openings 79 which face the fiber beard 16 from the other side and which also extend from a pressurized chamber 80.

The extension 75 and the upper part 78 form a channel 81 which is similarly constructed to standard splicers. This splicer-like channel 81 serves thus the opening of the fiber material 2 to single fibers 4, which are taken up directly downstream of the channel 81, that is shortly after the end of the fiber beard 16, by the take-up surface 19. Thus the single fibers 4 are prevented from excessive acceleration after they have been opened.

Figure 11:
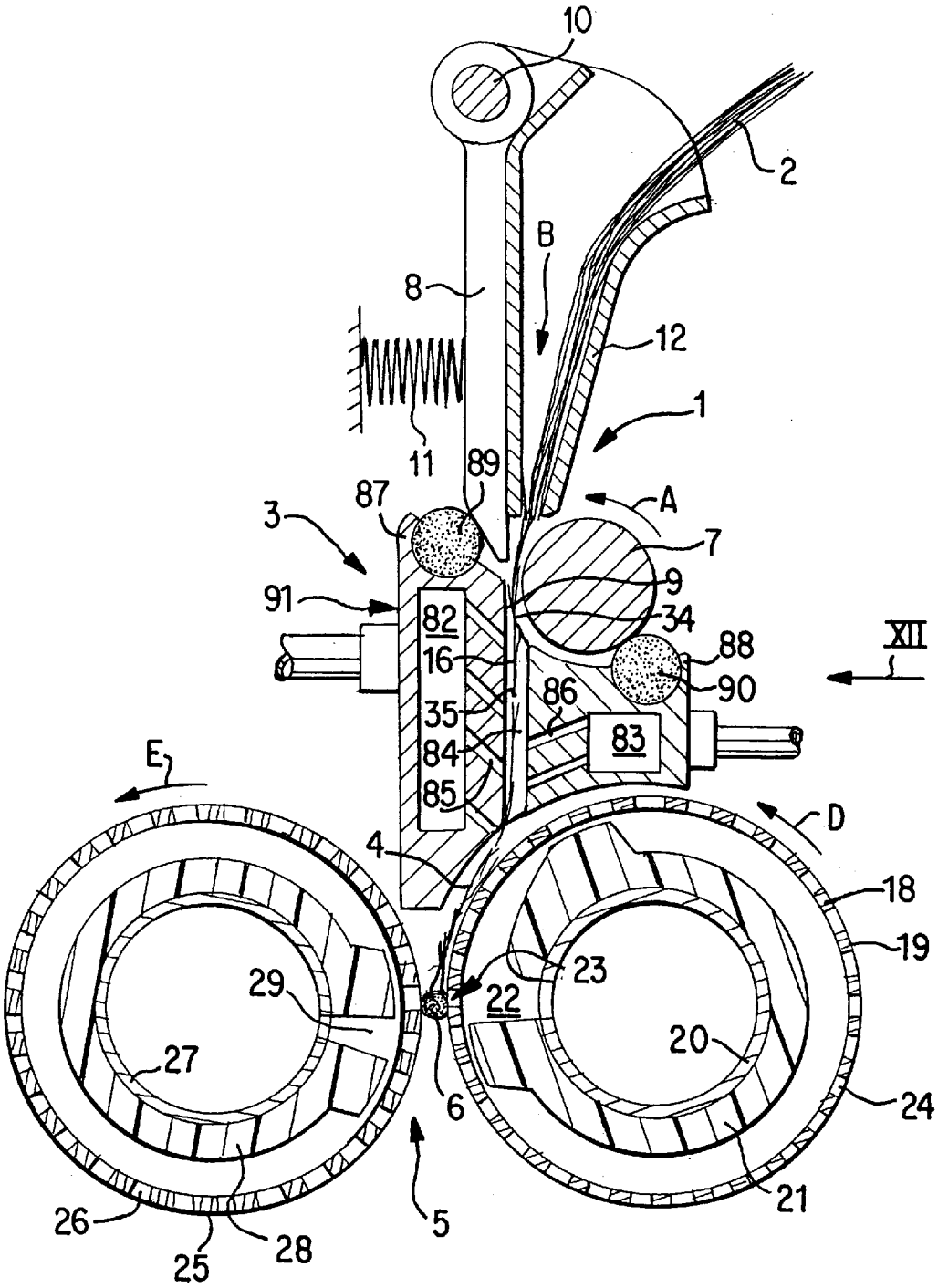
FIG. 11 is a view of FIG. 10, showing another preferred embodiment of the invention.

The embodiment in FIG. 11 differs from the embodiment in FIG. 10 essentially only in that the fiber opening device 3 is completely separated from the feed table 8.

Also in the embodiment in FIG. 11, two pressurized chambers 82 and 83 are formed, from which extend blow openings 85 and 86 which face a splicer-like channel 84. The length of the channel 84 is determined by the length of the single fibers 4 of the fiber material.

The housings containing the pressurized chambers 82 and 83 are provided with extensions 87 and 88 which face the feed table 8 and the feed roller 7, in which extensions 87 and 88 slide seals 89 and 90 are arranged. The slide seal 89 is located disposed with the feed table 8, while the slide seal 90 is disposed with the slowly rotating feed roller 7. The slide seals 89 and 90 can be formed, for example, by rubber tubes with good sliding properties, which prevent the blow air from the blow openings 85 and 86 going in the wrong direction.

Figure 12:
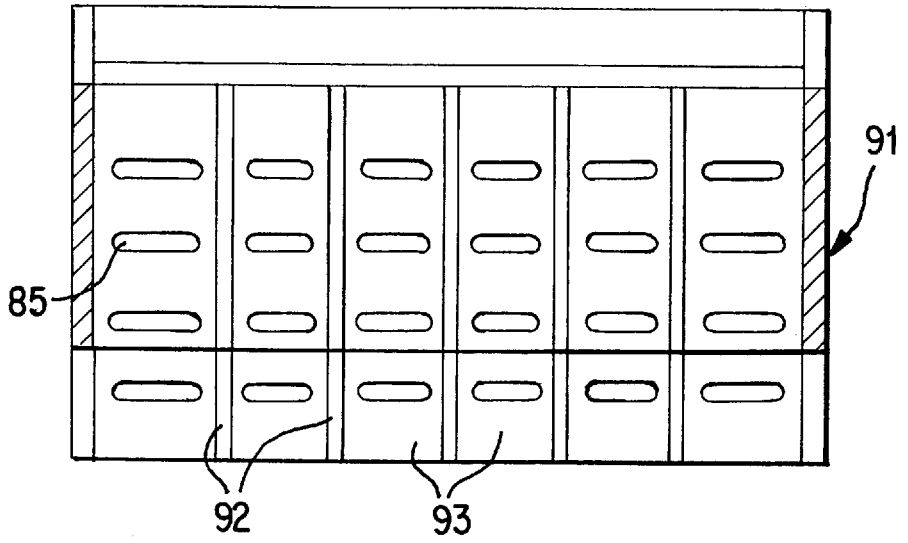
FIG. 12 is a view in arrow direction XII of FIG. 11 of a wall of the splicer-like channel.

The blow openings 85 and 86 can be formed as shown on the channel housing 91 in FIG. 12. This channel housing 91 borders a wall of the splicer-like channel 84, namely as shown in FIG. 11 on the left side.

As can be seen from FIG. 12, the blow openings 85 are advantageously transversely placed and separated from one another transversely to the transport direction of the single fibers 4 by raised separation lines 92, so that individual channels 93 arise. These serve the purpose of evening the air stream in the splicer-like channel 84, and in particular, of preventing cross flows.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An open-end spinning unit, comprising:

a feeding device forming a fiber beard nipping line for a fiber beard extending downstream of the nipping line, an opening device acting on a downstream area of the fiber beard to open the fiber beard into separate fibers, and a movable fiber take-up surface downstream of the opening device and directly downstream of the end area of the fiber beard which transports the fibers to a yarn formation line, wherein said opening device includes a fiber beard support guiding the downstream end area of the fiber beard and the separated fibers so that the fibers continuously extend in a substantially stable direction without substantial deflection as they travel between the nipping line and the take-up surface.

2. A spinning unit according to claim 1, wherein the take-up surface is an air-permeable peripheral surface of a driven roller suctioned from within, whose circumferential speed is at least as high as an arrival speed of single fibers at the take-up surface.

3. A spinning unit according to claim 1, wherein the opening device comprises an opening roller equipped with opening structure, and wherein the fiber beard support includes a supporting surface arranged adjacent the opening roller for the end area of the fiber beard.

4. A spinning unit according to claim 3, wherein the supporting surface is provided with at least one air-supply channel facing a peripheral surface of the opening roller and inclined in a circumferential direction thereof.

5. A spinning unit according to claim 3, wherein the supporting surface is provided at a nipping piece arranged adjacent the opening roller and pressed elastically against its peripheral surface.

6. A spinning unit according to claim 1, wherein the opening device comprises a driven roller with an air-permeable peripheral surface suctioned from within.

7. A spinning unit according to claim 6, wherein the fiber beard support includes an additional roller arranged adjacent the opening roller, said additional roller being similarly constructed but driven in an opposite direction to the opening roller.

8. A spinning unit according to claim 1, wherein the opening device comprises a channel provided with blast openings.

9. A spinning unit according to claim 1, wherein the opening device comprises a driven ventilation roller, and wherein the fiber beard support includes a supporting surface arranged adjacent the ventilation roller.

10. A spinning unit according to claim 9, wherein the supporting surface is provided with air-supply channels facing the circumferential direction of the ventilation roller.

11. An open-end spinning unit, comprising:

a feeding device forming a fiber beard nipping line for a fiber beard extending downstream of the nipping line, an opening device acting on a downstream end area of the fiber beard to open the fiber beard into separate fibers, and a fiber transport take up surface separate from the opening device and downstream of the end area of the fiber beard, which fiber transport take-up transports the fibers to a yarn formation line, wherein said opening device includes fiber beard support means for guiding the downstream end area of the fiber beard so that the fibers continuously extend in a substantially stable direction without deflection as they travel between the nipping line and the take up surface.

12. An open end spinning unit according to claim 11, wherein said fiber beard support means includes a fiber support surface which faces opening structure of said opening device.

13. An open end spinning unit according to claim 11, wherein said fiber beard support means includes a part with air supply openings directed against the fiber beard toward opening structure of said opening device.

14. An open end spinning unit according to claim 11, wherein said opening structure includes profiling on an opening roller, and wherein said fiber beard support means includes a resiliently biased nipping piece pressing said fiber beard against the opening roller profiling.

15. An open end spinning unit according to claim 11, wherein said opening structure includes air blowing openings on a roller, and wherein said fiber beard support means includes a part with air supply openings facing said roller and said fiber beard.

16. An open end spinning unit according to claim 11, wherein the opening device includes an opening roller, and wherein said fiber beard support means includes suction openings in said opening roller.

17. An open end spinning unit according to claim 11, wherein said opening device includes an opening roller, and wherein said fiber beard support means includes a suction roller facing the opening roller.

18. An open end spinning unit according to claim 11, wherein said opening device includes blow openings in an extension of a feed table of the feeding device, and wherein said fiber beard support means includes a part which forms a splicer channel along with the extension.

19. A method of making yarn using an open spinning process comprising:

feeding sliver in a feeding device forming a fiber beard nipping line for a fiber beard extending downstream of the nipping line, opening the fiber beard with an opening device acting on a downstream end area of the fiber beard to open the fiber beard into separate fibers, and taking up the fibers on a fiber transport take up surface downstream of the opening device and downstream of the end area of the fiber beard which transports the fibers to a yarn formation line, wherein said opening includes supporting the fiber beard at fiber beard support structure which holds the downstream end area of the fiber beard so that the fibers continuously extend in a substantially stable direction without deflection as they travel between the nipping line and the take up surface.

20. A method according to claim 19, wherein said fiber beard support structure includes a fiber support surface facing opening structure of said opening device.

21. An open end spinning unit according to claim 11, wherein said yarn formation line extends transversely of a travel direction of said fibers on said take-up surface.

22. A method according to claim 19, wherein said yarn formation line extends transversely of a travel direction of said fibers on said take-up surface.

23. A method according to claim 19, wherein the take-up surface is an air-permeable peripheral surface of a driven roller suctioned from within, whose circumferential speed is at least as high as an arrival speed of single fibers at the take-up surface.

24. A method according to claim 19, wherein the opening device comprises an opening roller equipped with opening structure, and wherein the fiber beard support structure includes a supporting surface arranged adjacent the opening roller for the end area of the fiber beard.

25. A method according to claim 24, wherein the supporting surface is provided with at least one air-supply channel facing a peripheral surface of the opening roller and inclined in a circumferential direction thereof.

26. A method according to claim 24, wherein the supporting surface is provided at a nipping piece arranged adjacent the opening roller and pressed elastically against its peripheral surface.

27. A method according to claim 19, wherein the opening device comprises a driven roller with an air-permeable peripheral surface suctioned from within.

28. A method according to claim 27, wherein the fiber beard support structure includes an additional roller arranged adjacent the opening roller, said additional roller being similarly constructed but driven in an opposite direction to the opening roller.

29. A method according to claim 19, wherein the opening device comprises a channel provided with blast openings.

30. A method according to claim 19, wherein the opening device comprises a driven ventilation roller, and wherein the fiber beard support includes a supporting surface arranged adjacent the ventilation roller.

31. A method according to claim 30, wherein the supporting surface is provided with air-supply channels facing the circumferential direction of the ventilation roller.

* * * * *